US010488095B2

(12) United States Patent
Winkle et al.

(10) Patent No.: US 10,488,095 B2
(45) Date of Patent: Nov. 26, 2019

(54) EVAPORATIVE COOLING SYSTEMS AND METHODS OF CONTROLLING PRODUCT TEMPERATURES DURING DELIVERY

(71) Applicant: Walmart Apollo, LLC, Bentonville, AR (US)

(72) Inventors: David C. Winkle, Bella Vista, AR (US); Brian G. McHale, Chadderton Oldham (GB); Donald R. High, Noel, MO (US); Todd D. Mattingly, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 196 days.

(21) Appl. No.: 15/598,699

(22) Filed: May 18, 2017

(65) Prior Publication Data

US 2017/0336125 A1 Nov. 23, 2017

Related U.S. Application Data

(60) Provisional application No. 62/338,224, filed on May 18, 2016.

(51) Int. Cl.
*F25D 3/06* (2006.01)
*F25D 7/00* (2006.01)
(Continued)

(52) U.S. Cl.
CPC ..... *F25D 3/06* (2013.01); *F25D 3/105* (2013.01); *F25D 7/00* (2013.01); *F25D 29/001* (2013.01);
(Continued)

(58) Field of Classification Search
CPC ..... F25D 3/06; F25D 7/00; F25D 2700/16; F25D 2600/04; F25B 19/00; F24F 2001/0085
(Continued)

(56) References Cited

U.S. PATENT DOCUMENTS 2,477,932 A 8/1949 King
3,450,196 A 6/1969 Bauer
(Continued)

FOREIGN PATENT DOCUMENTS

CA 2117944 8/1998
CN 1810583 8/2006
(Continued)

OTHER PUBLICATIONS

English Translation of DE4134322A1.*
(Continued)

*Primary Examiner* — Christopher R Zerphey
*Assistant Examiner* — Schyler S Sanks
(74) *Attorney, Agent, or Firm* — Fitch, Even, Tabin & Flannery LLP

(57) ABSTRACT

In some embodiments, systems and methods are provided that limit the change in temperature and/or control a temperature of a product during delivery. Some embodiments provide systems to limit temperature changes, comprising: an evaporative product cooling system comprising: a product cavity that supports a product while the product is transported to a delivery location, wherein the product cooling system comprises an interior wall defining the product cavity, an exterior wall, an evaporative cavity between the interior and exterior walls, a coolant dispensing system, at least one evaporative opening, and a temperature sensor; and a temperature control circuit configured to receive temperature data from the temperature sensor while the product is in transit, determine that a temperature of the product is greater than a transport temperature threshold, and autonomously activate the coolant dispensing system to release evaporative coolant into the evaporative cavity while the product is transported.

14 Claims, 3 Drawing Sheets

(51) Int. Cl.
*F25D 29/00* (2006.01)
*F25D 3/10* (2006.01)

(52) U.S. Cl.
CPC ..... *F25D 29/003* (2013.01); *F25D 2500/04* (2013.01); *F25D 2600/04* (2013.01); *F25D 2700/16* (2013.01)

(58) Field of Classification Search
USPC ..... 62/457.1
See application file for complete search history.

(56) References Cited

U.S. PATENT DOCUMENTS

| | | | |
|---|---|---|---|
| 3,726,106 | A | 4/1973 | Jaeger |
| 3,831,389 | A | 8/1974 | Lipona |
| 3,961,925 | A | 6/1976 | Rhoad |
| 4,462,461 | A | 7/1984 | Grant |
| 4,823,554 | A | 4/1989 | Trachtenberg |
| 4,936,100 | A | 6/1990 | Leppa |
| 5,290,580 | A | 3/1994 | Floyd |
| 5,337,579 | A | 8/1994 | Saia |
| 5,669,233 | A | 9/1997 | Cook |
| 5,813,454 | A | 9/1998 | Potter |
| 5,826,432 | A | 10/1998 | Ledbetter |
| 5,908,649 | A | 6/1999 | Floyd |
| 6,003,322 | A | 12/1999 | Graham |
| 6,029,457 | A | 2/2000 | Neeser |
| 6,209,343 | B1 | 4/2001 | Owen |
| 6,244,458 | B1 | 6/2001 | Frysinger |
| 6,382,141 | B1 | 5/2002 | Maynor |
| 6,390,378 | B1 | 5/2002 | Briscoe |
| 6,412,287 | B1 | 7/2002 | Hughes |
| 6,427,475 | B1 | 8/2002 | Defelice |
| 6,536,189 | B1 | 3/2003 | Murray |
| 6,551,182 | B2 | 4/2003 | Caracciolo |
| 6,555,789 | B2 | 4/2003 | Owens |
| 6,584,797 | B1 | 7/2003 | Smith |
| 6,732,534 | B2 | 5/2004 | Spry |
| 6,763,666 | B2 | 7/2004 | Fong |
| 6,789,391 | B2 | 9/2004 | Graham |
| 6,817,202 | B1 | 11/2004 | Anthony |
| 6,968,711 | B2 | 11/2005 | Smith |
| 7,073,338 | B2 | 7/2006 | Harwood |
| 7,130,771 | B2 | 10/2006 | Aghassipour |
| 7,310,967 | B2 | 12/2007 | Aragon |
| 7,407,065 | B2 | 8/2008 | Hooks |
| 7,650,757 | B2 | 1/2010 | Bhatti |
| 7,784,301 | B2 | 8/2010 | Sasaki |
| 7,849,708 | B2 | 12/2010 | Goncharko |
| 7,913,511 | B2 | 3/2011 | Meyer |
| 8,151,599 | B2 | 4/2012 | Sixt |
| 8,375,730 | B2 | 2/2013 | Haarmann |
| 8,600,903 | B2 | 12/2013 | Eller |
| 8,783,002 | B2 | 7/2014 | Bowden |
| 8,881,540 | B1 | 11/2014 | Barakat |
| 8,905,744 | B2 | 12/2014 | Fruth |
| 8,948,935 | B1 | 2/2015 | Peeters |
| 9,163,863 | B1 | 10/2015 | Armstrong |
| 9,290,313 | B2 | 3/2016 | De Lesseux |
| 9,310,279 | B2 | 4/2016 | Crombie |
| 9,536,216 | B1 | 1/2017 | Lisso |
| 1,572,458 | A1 | 10/2017 | Winkle |
| 10,005,609 | B1 | 6/2018 | Biene |
| 10,040,552 | B2 | 8/2018 | Gordon |
| 10,071,804 | B1 | 9/2018 | Buchmueller |
| 10,169,735 | B2 | 1/2019 | Lund |
| 10,207,804 | B1 | 2/2019 | Gentry |
| 2002/0040586 | A1 | 4/2002 | Glenk |
| 2003/0014993 | A1 | 1/2003 | Smith |
| 2003/0163225 | A1 | 8/2003 | Hanson |
| 2004/0226309 | A1 | 11/2004 | Broussard |
| 2004/0243353 | A1 | 12/2004 | Aghassipour |
| 2005/0091988 | A1 | 5/2005 | Stewart |
| 2006/0208881 | A1 | 9/2006 | Suzuki |
| 2007/0018791 | A1 | 1/2007 | Johnson |
| 2007/0193297 | A1 | 8/2007 | Wilson |
| 2008/0060376 | A1 | 3/2008 | Espinosa |
| 2008/0128095 | A1 | 6/2008 | Van Zutven |
| 2008/0242752 | A1 | 10/2008 | Delaviz |
| 2008/0260303 | A1 | 10/2008 | De Lesseux |
| 2008/0282705 | A1 | 11/2008 | Hue |
| 2008/0291033 | A1 | 11/2008 | Aghassipour |
| 2008/0308452 | A1 | 12/2008 | Eller |
| 2009/0049845 | A1 | 2/2009 | McStravick |
| 2010/0047546 | A1 | 2/2010 | Malshe |
| 2010/0064698 | A1 | 3/2010 | Schabron |
| 2010/0251731 | A1 | 10/2010 | Bergida |
| 2011/0084162 | A1 | 4/2011 | Goossen |
| 2011/0186591 | A1 | 8/2011 | Pfister |
| 2011/0221573 | A1 | 9/2011 | Huat |
| 2012/0111044 | A1 | 5/2012 | Chen |
| 2012/0210677 | A1 | 8/2012 | Proskin |
| 2012/0227856 | A1 | 9/2012 | Sinacori |
| 2013/0020309 | A1 | 1/2013 | Tattam |
| 2013/0045870 | A1 | 2/2013 | Rogers |
| 2013/0048264 | A1 | 2/2013 | Lu |
| 2013/0073477 | A1 | 3/2013 | Grinberg |
| 2013/0111937 | A1 | 5/2013 | Hendrix |
| 2013/0333396 | A1 | 12/2013 | Handley |
| 2014/0032034 | A1 | 1/2014 | Raptopoulos |
| 2014/0144161 | A1 | 5/2014 | Pointer |
| 2014/0157794 | A1 | 6/2014 | McGann |
| 2014/0157797 | A1 | 6/2014 | Kovalick |
| 2014/0216101 | A1 | 8/2014 | Dubreuil |
| 2015/0006005 | A1 | 1/2015 | Yu |
| 2015/0120094 | A1 | 4/2015 | Kimchi |
| 2015/0120597 | A1 | 4/2015 | Dertadian |
| 2015/0183528 | A1 | 7/2015 | Walsh |
| 2015/0192475 | A1 | 7/2015 | Eisenstadt |
| 2015/0291868 | A1 | 10/2015 | Rajagopalan |
| 2016/0016664 | A1 | 1/2016 | Basuni |
| 2016/0084577 | A1* | 3/2016 | Chou ..... F28C 3/08 62/271 |
| 2016/0107750 | A1 | 4/2016 | Yates |
| 2016/0124435 | A1 | 5/2016 | Thompson |
| 2016/0159496 | A1 | 6/2016 | O'Toole |
| 2016/0183730 | A1 | 6/2016 | Bedi |
| 2016/0235236 | A1 | 8/2016 | Byers |
| 2016/0265796 | A1 | 9/2016 | Carbone |
| 2017/0203857 | A1 | 7/2017 | O'Toole |
| 2017/0336126 | A1 | 11/2017 | Winkle |
| 2017/0351999 | A1 | 12/2017 | Winkle |
| 2017/0363349 | A1 | 12/2017 | McHale |
| 2018/0031296 | A1 | 2/2018 | Winkle |
| 2018/0096294 | A1 | 4/2018 | Winkle |

FOREIGN PATENT DOCUMENTS

| | | | | |
|---|---|---|---|---|
| CN | 202345497 | | 7/2012 | |
| CN | 103723001 | | 4/2014 | |
| CN | 203699065 | | 7/2014 | |
| DE | 4134322 | A1 * | 4/1993 | ..... F25D 7/00 |
| EP | 2006620 | A2 * | 12/2008 | ..... F25D 7/00 |
| EP | 2604956 | | 6/2013 | |
| EP | 2614729 | | 7/2013 | |
| EP | 2158814 | | 8/2013 | |
| GB | 1198354 | | 7/1970 | |
| WO | 98031608 | | 7/1998 | |
| WO | 1999064818 | | 12/1999 | |
| WO | 0108983 | | 7/2002 | |
| WO | 03013318 | | 4/2003 | |
| WO | 2006072210 | | 7/2006 | |
| WO | 2006124149 | | 4/2008 | |
| WO | 2010044107 | | 4/2010 | |
| WO | 2011061431 | | 5/2011 | |
| WO | 2013063374 | | 5/2013 | |
| WO | 2017201118 | | 11/2017 | |
| WO | 2017201230 | | 11/2017 | |

OTHER PUBLICATIONS

U.S. Appl. No. 15/598,699, filed May 18, 2017, David C. Winkle.
U.S. Appl. No. 15/598,718, filed May 18, 2017, David C. Winkle

(56) References Cited

OTHER PUBLICATIONS

U.S. Appl. No. 15/611,487, filed Jun. 1, 2017, David C. Winkle
U.S. Appl. No. 15/624,211, filed Jun. 15, 2017, Brian G. McHale.
U.S. Appl. No. 15/660,153, filed Jul. 26, 2017, David C. Winkle.
U.S. Appl. No. 62/403,909, filed Oct. 4, 2016, David C. Winkle.
AGA; "Transportation Cooling"; http://www.aga.se/en/processes_ren/freezing_cooling/transportation_cooling/index.html; Available at least as early as Jan. 21, 2016; pp. 1-3.
Fedex Express; "Packaging Perishable Shipments"; May 2015; pp. 1-8.
Krapfl, Mike; "Researcher working to save energy with nanotechnology insulation", Phys.org, http://phys.org/news/2014-12-energy-nanotechnology-insulation.html, Dec. 2, 2014, pp. 1-4.
Prevenslik, T.; "QED Cooling of Structures by Nanoscale Coatings", Proceedings of the 5th International Conference on Nanostructures, Mar. 6-9, 2014, pp. 1-3.
Raman, Aaswath, et al.; "Photonic Radiative Cooling", 2015 Technology Application for Cleantech to Market (C2M), 2015, pp. 1-4.
Stauth, David; "Nanotech yields major advance in heat transfer, cooling technologies", Oregon State University, http://oregonstate.edu/ua/ncs/archives/2010/jun/nanotech-yields-major-advance-heat-transfer-cooling-technologies, Jun. 9, 2010, pp. 1-3.
Wikipedia; "Pot-in-pot refrigerator"; https://web.archive.org/web/20150606152436/https://en.wikipedia.org/wiki/Pot-in-pot_refrigerator; Jun. 2015; pp. 1-2.
PCT; App. No. PCT/US2017/033025 ; International Search Report and Written Opinion dated Aug. 16, 2017.
PCT; App. No. PCT/US2017/033236; International Search Report and Written Opinion dated Aug. 14, 2017.
PCT; App. No. PCT/US2017/035631; International Search Report and Written Opinion dated Aug. 22, 2017.
PCT; App. No. PCT/US2017/037698; International Search Report and Written Opinion dated Sep. 1, 2017.
PCT; App. No. PCT/US2017/042769; International Search Report and Written Opinion dated Sep. 27, 2017.
Alexey Negrash; "Nano Liquid Ceramic Thermal Insulation Coating ( LCTIC ) Thermal Barrier Paint"; https://www.youtube.com/watch?v=X8F18IY9PmY; published on Jul. 16, 2013; pp. 1-6.
Liu Jiang; "Wall thermal insulation nano—coating"; https://www.youtube.com/watch?v=yF4NnNTPITQ; published on Nov. 14, 2015; pp. 1-17.
PCT; App. No. PCT/US2017/033016; International Search Report and Written Opinion dated Jan. 5, 2018.
PCT; App. No. PCT/US2017/033246; International Search Report and Written Opinion dated Aug. 23, 2017.
PCT; App. No. PCT/US2017/054843; International Search Report and Written Opinion dated Dec. 18, 2017
SBC Magazine; "Spray 'Nano-Insulation' Applied to Windows During Energy Retrofit"; https://www.sbcmag.info/news/2016/oct/spray-nano-insulation-applied-windows-during-energy-retrofit; published on Oct. 17, 2016; pp. 1-5.
U.S. Appl. No. 16/301,993, filed Nov. 15, 2018, David C. Winkle.
U.S. Appl. No. 16/301,999, filed Nov. 15, 2018, David C. Winkle.
U.S. Appl. No. 15/598,718; Office Action dated Oct. 11, 2018.
U.S. Appl. No. 15/660,153; Notice of Allowance dated Nov. 5, 2018.
U.S. Appl. No. 15/660,153; Office Action dated Jun. 4, 2018.
U.S. Appl. No. 15/724,583; Office Action dated Mar. 18, 2019.

* cited by examiner

EVAPORATIVE COOLING SYSTEMS AND METHODS OF CONTROLLING PRODUCT TEMPERATURES DURING DELIVERY

CROSS-REFERENCE TO RELATED APPLICATION

This application claims the benefit of U.S. Provisional Application No. 62/338,224, filed May 18, 2016, which is incorporated herein by reference in its entirety.

TECHNICAL FIELD

This invention relates generally to product temperature control systems.

BACKGROUND

In a modern retail environment, there is a need to improve the customer service and/or convenience for the customer. One aspect of customer service is the delivery of products. There are numerous ways to delivery products to customers. Getting the product to a delivery location, however, can adversely affect the product, can cause undesirable delays, can add cost and reduce revenue.

BRIEF DESCRIPTION OF THE DRAWINGS

Disclosed herein are embodiments of systems, apparatuses and methods pertaining to product temperature control systems. This description includes drawings, wherein.

Figure 1:
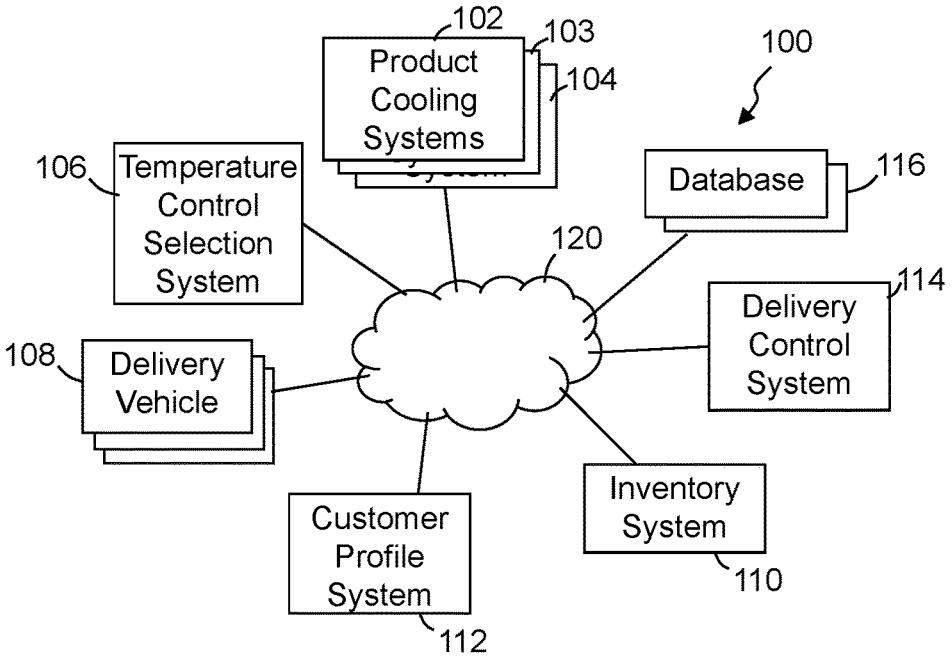
FIG. 1 illustrates a simplified block diagram of an exemplary product delivery coordinating system configured to coordinate and/or schedule delivery of products while limiting temperature changes and/or maintaining temperatures of one or more products while transported to one or more delivery locations, in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

The following description is not to be taken in a limiting sense, but is made merely for the purpose of describing the general principles of exemplary embodiments. Reference throughout this specification to "one embodiment," "an embodiment," "some embodiments", "an implementation", "some implementations", "some applications", or similar language means that a particular feature, structure, or characteristic described in connection with the embodiment is included in at least one embodiment of the present invention. Thus, appearances of the phrases "in one embodiment," "in an embodiment," "in some embodiments", "in some implementations", and similar language throughout this specification may, but do not necessarily, all refer to the same embodiment.

Generally speaking, pursuant to various embodiments, systems, apparatuses and methods are provided herein useful to limit changes in temperature of one or more products being transported to a delivery location. By limiting changes of temperature, products can be kept below threshold temperatures, maintain a freshness of products, and other such benefits. In some embodiments, the system identifies various delivery parameters in selecting a cooling system, from multiple different available cooling systems, that is to be used in limiting temperature changes and/or maintaining temperatures of one or more products while the one or more products are transported to one or more delivery locations. The cooling systems can be implemented to provide temperature control of one or more products, typically a limited number of products, and without having to control the temperature of an entire delivery vehicle or large compartment of a delivery vehicle. Accordingly, the multiple product cooling systems can limit temperature variations and/or control temperatures specific to individual or limited numbers of products. Further, in some embodiments the cooling systems are configured to have a relatively small volume. In some implementations, the product temperature control systems (e.g., product cooling systems) can provide individual temperature control for a single product. Such individual temperature control allows individual products to be transported by some delivery methods while still maintaining desired temperature thresholds, and/or can transport one or more products that are to be maintained at different desired temperatures along with other products that do not require temperature control by the same delivery vehicle.

FIG. 1 illustrates a simplified block diagram of an exemplary product delivery coordinating system 100 that is configured to coordinate and/or schedule delivery of products while limiting temperature changes and/or maintaining temperatures of one or more products while transported to one or more delivery locations, in accordance with some embodiments. The system 100 includes multiple different types of product cooling systems 102-104 and/or product heating systems, a temperature control selection system 106, and multiple different types of delivery vehicles 108. Some embodiments further include one or more inventory systems 110 associated with one or more retail facilities, customer profile system 112, delivery control system 114, and one or more databases 116 (e.g., one or more customer databases, inventory databases, product databases, route parameter databases, etc.). One or more computer and/or communication networks 120 establish communication connections between two or more of the components of the system 100 and allow communications and/or data transmissions between two or more of the components of the system 100. In some embodiments, the delivery coordinating system 100 is associated with one or more retail facilities from which products can be purchased and/or that coordinates delivery of those products. The shopping facility may, in some instances, be a retail sales facility, a fulfillment center, a distribution center, or other type of facility in which products are sold and/or distributed to customers. The facility may be any size or format, and may include products from one or more merchants. For example, a facility may be a single store operated by one merchant, a chain of two or more stores operated by one entity, or may be a collection of stores covering multiple merchants.

The temperature control selection system 106 utilizes product parameters and delivery parameters in evaluating which product cooling system and/or delivery vehicle are to be employed in transporting one or more products to one or more delivery locations. Typically, the temperature control selection system identifies products that have one or more temperature thresholds that are to be maintained and/or not to be exceeded. For example, a product may have one or more of a desired storage threshold temperature, a desired transport temperature, a regulatory or government specified temperature threshold, other such temperature thresholds, and in some instances a combination of two or more temperature thresholds. Further, some of the temperature thresholds may correspond to time thresholds, where for a particular product it may be desired that the product be maintained below a first temperature threshold, but can exceed the first temperature for less than a threshold duration of time and typically while being maintained under a second temperature threshold. One or more databases may be accessed (e.g., product database, inventory database, regulatory database, etc.) to obtain information about one or more temperature thresholds and/or corresponding duration thresholds, transportation parameters, delivery parameters, customer preferences, and/or other such information, including relevant historic information.

Further, the temperature control selection system typically takes into consideration transportation parameters in selecting a product cooling system 102-104 to be used in transporting one or more products. The transport parameters can include, but are not limited to, expected duration of transport and/or duration of exposure to non-temperature controlled environments (e.g., outside of a freezer or refrigerator), predicted and/or forecasted environmental conditions through which the product(s) is to be transported (e.g., temperatures, humidity, potential wind, precipitation, etc.), and other such information. The transportation parameters may be obtained based on historic data (e.g., historic weather and temperatures, historic traffic patterns, data obtained from similar previous deliveries, etc.) and forecasted data (e.g., forecasted weather, forecasted traffic, etc.), current data, and the like. Further, the transportation parameters may be obtained based on information collected by the retail store or chain of stores, and/or one or more third party sources (e.g., one or more weather services, traffic service, delivery service, etc.). Typically, the transportation parameters can further include and/or consider the time, temperature, mode of transport, type of delivery vehicle, and the like associated with the preparation and/or loading of the product into a cooling system and/or the delivery vehicle, the unloading of the delivery vehicle, and other such factors. The system may take other parameters into consideration including, but not limited to, product parameters (e.g., type of product, size of product, size of multiple products (e.g., sum of volumes and/or volume of strategically arranged products), and the like), customer requests, types of delivery location, whether a temperature control system is available at the delivery location, whether a customer is expected to be available to receive the product(s) at the time of delivery, and other such parameters, and often a combination of two or more of such parameters.

Figure 2:
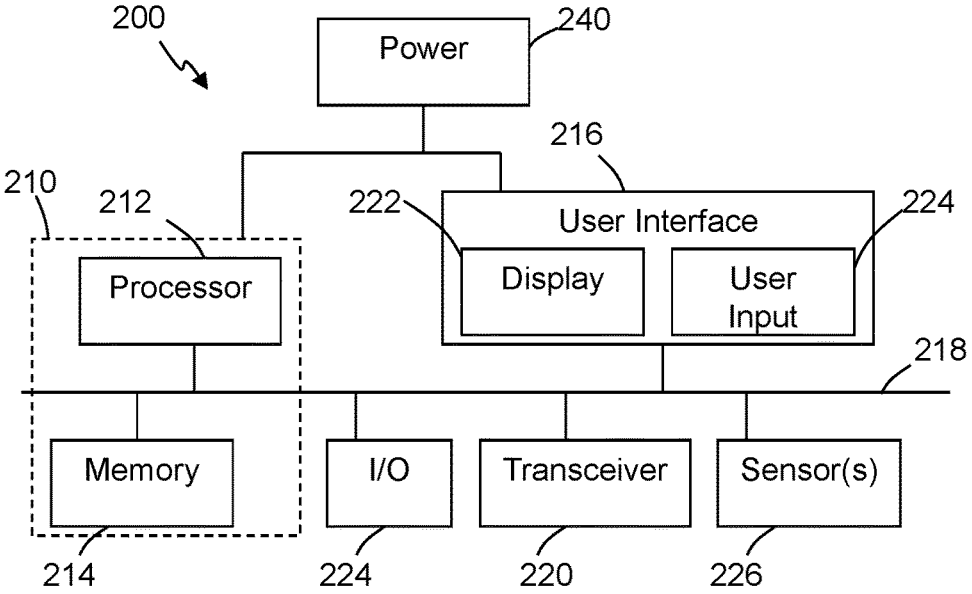
FIG. 2 illustrates an exemplary system for use in implementing methods, techniques, devices, apparatuses, systems, servers, sources and the like in limiting temperature changes of a product during transit, in accordance with some embodiments.

Further, the processes, methods, techniques, circuits, circuitry, systems, devices, functionality, services, servers, sources and the like described herein may be utilized, implemented and/or run on many different types of devices and/or systems. FIG. 2 illustrates an exemplary system 200 that may be used for implementing any of the components, circuits, circuitry, systems, functionality, apparatuses, process, or device of the system 100 of FIG. 1 and/or mentioned above or below, or parts of such circuit, circuitry, functionality, systems, apparatuses, processes, or devices. For example, the system 200 may be used to implement some or all of the product cooling systems 102-104, a temperature control selection system 106, delivery vehicles 108, inventory systems 110, customer profile system 112, delivery control system 114, and/or other such components, circuitry, functionality and/or devices. However, the use of the system 200 or any portion thereof is certainly not required.

By way of example, the system 200 may comprise a control circuit or processor module 212, memory 214, and one or more communication links, paths, buses or the like 218. Some embodiments may include one or more user interfaces 216, and/or one or more internal and/or external power sources or supplies 240. The control circuit 212 can be implemented through one or more processors, microprocessors, central processing unit, logic, local digital storage, firmware, software, and/or other control hardware and/or software, and may be used to execute or assist in executing the steps of the processes, methods, functionality and techniques described herein, and control various communications, decisions, programs, content, listings, services, interfaces, logging, reporting, etc. Further, in some embodiments, the control circuit 212 can be part of control circuitry and/or a control system 210, which may be implemented through one or more processors with access to one or more memory 214 that can store code that is implemented by the control circuit and/or processors to implement intended functionality. In some applications, the control circuit and/or memory may be distributed over a communications network (e.g., LAN, WAN, Internet) providing distributed and/or redundant processing and functionality. Again, the system 200 may be used to implement one or more of the above or below, or parts of, components, circuits, systems, process and the like. For example, the system may implement the temperature control selection system 106 with the control circuit being a selection system control circuit, product cooling system with the control circuit being a cooling system control circuit, a product delivery control system with the control circuit being a product delivery control circuit, a temperature control system with a temperature control circuit, or other components.

The user interface 216 can allow a user to interact with the system 200 and receive information through the system. In some instances, the user interface 216 includes a display 222 and/or one or more user inputs 224, such as a buttons, touch screen, track ball, keyboard, mouse, etc., which can be part of or wired or wirelessly coupled with the system 200. Typically, the system 200 further includes one or more communication interfaces, ports, transceivers 220 and the like allowing the system 200 to communicate over a communication bus, a distributed computer and/or communication network 120 (e.g., a local area network (LAN), the Internet, wide area network (WAN), etc.), communication link 218, other networks or communication channels with other devices and/or other such communications or combinations thereof. Further the transceiver 220 can be configured for wired, wireless, optical, fiber optical cable, satellite, or other such communication configurations or combinations of two or more of such communications. Some embodiments include one or more input/output (I/O) ports 234 that allow one or more devices to couple with the system 200. The I/O ports can be substantially any relevant port or combinations of ports, such as but not limited to USB, Ethernet, or other such ports.

The system 200 comprises an example of a control and/or processor-based system with the control circuit 212. Again, the control circuit 212 can be implemented through one or more processors, controllers, central processing units, logic, software and the like. Further, in some implementations the control circuit 212 may provide multiprocessor functionality.

The memory 214, which can be accessed by the control circuit 212, typically includes one or more processor readable and/or computer readable media accessed by at least the control circuit 212, and can include volatile and/or nonvolatile media, such as RAM, ROM, EEPROM, flash memory and/or other memory technology. Further, the memory 214 is shown as internal to the control system 210; however, the memory 214 can be internal, external or a combination of internal and external memory. Similarly, some or all of the memory 214 can be internal, external or a combination of internal and external memory of the control circuit 212. The external memory can be substantially any relevant memory such as, but not limited to, solid-state storage devices or drives, hard drive, one or more of universal serial bus (USB) stick or drive, flash memory secure digital (SD) card, other memory cards, and other such memory or combinations of two or more of such memory. The memory 214 can store code, software, executables, scripts, data, content, lists, programming, programs, log or history data, user information and the like. While FIG. 2 illustrates the various components being coupled together via a bus, it is understood that the various components may actually be coupled to the control circuit and/or one or more other components directly.

Some embodiments include the I/O interface 234 that allows wired and/or wireless communication coupling of to external components, such as with one or more product cooling systems 102-104, temperature control selection system 106, delivery vehicles 108, inventory systems 110, customer profile system 112, delivery control system 114, databases 116, and other such devices or systems. Typically, the I/O interface provides wired communication and/or wireless communication (e.g., Wi-Fi, Bluetooth, cellular, RF, and/or other such wireless communication), and in some instances may include any known wired and/or wireless interfacing device, circuit and/or connecting device, such as but not limited to one or more transmitters, receivers, transceivers, or combination of two or more of such devices.

In some implementations, the system 200 includes one or more sensors 226 that can communicate sensor data to the control circuit 212 and/or other systems. The sensors can include one or more temperature sensors, humidity sensors, inertial sensors, wind speed sensors, acceleration sensors, velocity sensors, weight sensor systems, dimensions sensor systems, product identifying sensor systems (e.g., RFID tag readers, bar code scanners, cameras and text capture systems, etc.), other such sensors, or combination of two or more of such sensors. The sensors may communicate wired or wirelessly over the communication link 218, the distributed computer and/or communication network 120, or the like. Further, the sensors 226 are illustrated directly coupled with the control circuit 212 via the communication link 218; however, one or more sensors may be internal, external or a combination of internal and external, other networks or communication channels with other devices and/or other such communications or combinations thereof. For example, in some applications one or more temperature sensors may be positioned within a product cavity of a cooling system, adjacent to or as part of a product holder, incorporated into insulation, external to a housing of a cooling system, other such locations, or combination of two or more of such locations. Additionally or alternatively, one or more sensors and/or sensor systems may be cooperated with and/or positioned as part of or adjacent to a conveyor system that transports products in preparation for delivery, as part of a transport system (e.g., forklift, pallet jack, etc.), and/or other such systems.

As described above, some embodiments include the temperature control selection system 106 that evaluates multiple parameters to select one or more product temperature control systems, from multiple different types of temperature control systems, to be used while delivering one or more products. The temperature control systems can comprise one or more evaporative temperature control systems with an evaporative control system control circuit, cryogenic substance cooling systems with a cryogenic cooling system control circuit, aerosol temperature control systems with an aerosol control system control circuit, temperature pack cooling systems, cooling sustaining bag systems, heat pack temperature systems, other temperature control systems, or combination of two or more of such systems. In some embodiments, the temperature control selection system 106 further takes into consideration expected rates of change in temperature and/or expected heat transfer of the one or more products, applied cryogenic substance, insulation, insulation rating or thermal resistance rating, and the like. In some embodiments, the rate of change of temperature is calculated based on a formula for each flow (e.g., $\Delta Q/\Delta t = -K \times A \times \Delta T/x$, where $\Delta Q/\Delta t$ is the rate of heat flow; $-K$ is the thermal conductivity factor; A is the surface area; $\Delta T$ is the change in temperature and x is the thickness of the material).

Figure 3:
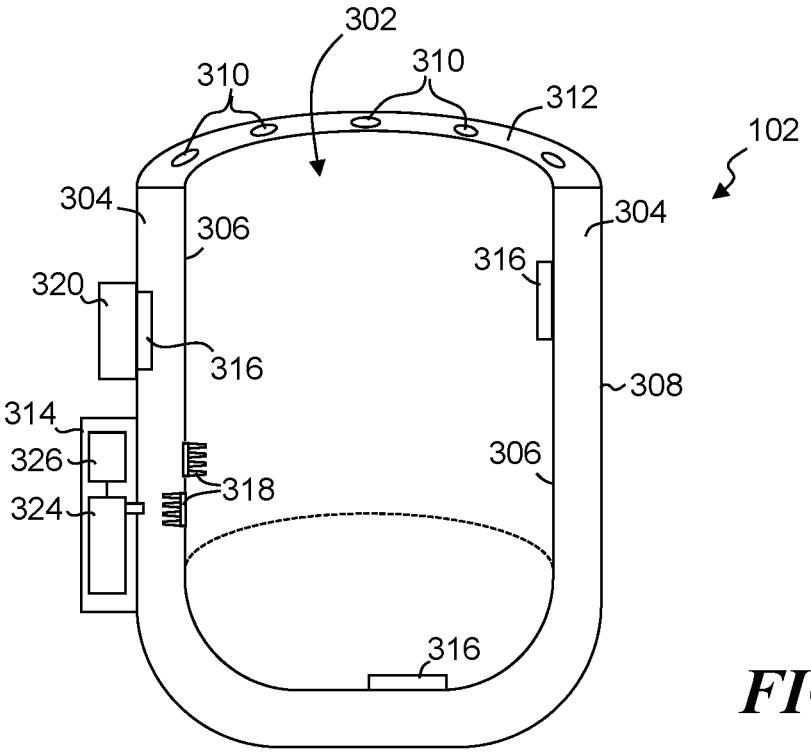
FIG. 3 illustrates a simplified cross-sectional view of an exemplary evaporative product cooling system, in accordance with some embodiments.

FIG. 3 illustrates a simplified cross-sectional view of an exemplary evaporative product cooling system 102, in accordance with some embodiments. The evaporative product cooling system 102 includes a product cavity 302 that supports and/or receives one or more products while the one or more products are transported by a delivery vehicle to a delivery location. Further, the evaporative product cooling system 102 includes an evaporative cavity 304 defined between an interior barrier or wall 306 and an exterior barrier or wall 308. The product cooling system 102 is separate from and removable from the delivery vehicle. The size of the product cooling system 102 can vary, but often is configured to hold a relatively small number of products, such as products that collectively have a volume of less than three cubic feet, typically less than two cubic feet, and often less than one cubit foot. Depending on the size of the product, often the cooling system is capable of only receiving a single product. In some embodiments, the cooling system has dimensions that are only marginally larger than the one or more products being received by the cooling system. Further, the evaporative product cooling systems may have multiple different sizes, with a particular cooling system being selected based on the size or volume of one or more products intended to be placed into the product cavity. For example, in some applications, the cooling system adds less than 15% to a total volume of the one or more products (and their packaging) being received, while in some instances is sized such that it adds 10% or less to a volume of the one or more products being received by the cooling system. Although not shown, some embodiments include a lid to close the product cavity. The lid may be part of the exterior and/or interior walls or a separate piece that separates from the product cavity.

In some implementations, the interior and/or exterior walls are rigid, while in other implementations one or both of the interior and exterior walls may be flexible. For example, the interior and exterior walls may, in some embodiments, be formed from a plastic, wax coated paper, or other materials. The interior wall is typically moisture resistant and/or water proof. In the bag configuration, portions of the interior and/or exterior wall may be rolled and/or folded over to close the product cavity. In some embodiments, the evaporative product cooling system 102 further includes a mounting or coupling system that is configured to secure the cooling system with a delivery vehicle. In some instances, the coupling system includes an aperture and/or gripper to cooperate with a hook (e.g., to be suspended by an unmanned aerial system (UAS)), or other such system that secures the evaporative product cooling system 102 with the delivery vehicle. Other embodiments may include latches that secure with a delivery vehicle, grooves that receive tongs or other structure of a delivery vehicle, or other such structures that can be used to releasably cooperate the evaporative product cooling system with the delivery vehicle.

The width of the evaporative cavity can be configured based on an expected quantity of evaporative coolant to be maintained within the evaporative cavity. Further, in some instances the width of the evaporative cavity may vary (e.g., wider at a top than at a bottom, wider proximate one or more evaporative openings, or some other configuration). One or more evaporative openings 310 are formed in the exterior wall 308 and/or top 312 of the cooling system exposing a portion of the evaporative cavity to an exterior environment. In some instances, the top 312 may be substantially open exposition substantially an entire area of the top to the exterior environment. An array of evaporative openings may be formed in one or more areas of the exterior wall. In some instances, evaporative holes on the external wall are incorporated into a limited area allowing control of airflow into and/or across these holes based on an orientation of the product cooling system 102 while being transported. Some embodiments may include flared fins, flaps or the like formed adjacent one or more of the evaporative openings to allow for additional control of airflow into the evaporative openings based on an orientation of the opening relative to a direction of travel. Further, in some instances the lid may act to in part control the area of one or more of the evaporative opens that are exposed to the environment. For example, the lid may be rotated to control an amount of one or more of the evaporative openings that are exposed. The product cooling system 102 further includes one or more coolant dispensing systems 314 that couples with the evaporative cavity, one or more temperature sensors 316, and a temperature control circuit or system 320 that couples with at least one temperature sensor and the coolant dispensing system 314. The temperature control circuit 320 can be part of the coolant dispensing system or coupled with the coolant dispensing system, and providing at least some control over the coolant dispensing system.

At least one of the temperature sensors is positioned to detect in real time a temperature corresponding to a temperature of one or more products within the cooling system while the one or more products are in transit to be delivered to a delivery location. In some instances, a temperature sensor may be positioned in contact with a product within the product cavity 302. Additionally or alternatively, one or more temperature sensors may be positioned at one or more locations within the product cavity. Some embodiments include one or more temperature sensors that can detect temperatures outside of the cooling system. In some embodiments, one or more other types of sensors may be included, such as but not limited to one or more humidity sensors, inertia sensors, orientation sensors (e.g., tilt, roll, pitch, yaw, etc.), airflow sensors, other such sensors, or combination of two or more of such sensors. The sensors are in wired or wireless communication with the temperature control circuit 320 and provide sensor data to the temperature control circuit.

The temperature control circuit 320 receives temperature data from the one or more temperature sensors and/or receive other senor data from one or more other sensor while the one or more products are in the product cavity and/or at least while the one or more products are in transit to a delivery location. Based on current temperature data the temperature control circuit can determine or identify when a temperature of the one or more products is greater than one or more transport temperature thresholds. The transport temperature threshold may be specific to a particular product and typically varies between products. Further, the transport temperature threshold may be limited to while the product is in transit, while one or more other temperature thresholds may be relevant to the product while the product is at a retail facility or other storage location. For example, for some products that are kept cold a transport temperature threshold may be greater than a storage temperature threshold (e.g., ice cream may have a transport temperature threshold that allows a slow melting of the ice cream, while the storage temperature threshold maintains the ice cream in a frozen state). Further, some transport temperature thresholds may further be associated with a time threshold. For example, some products may have multiple transport temperature thresholds with a first transport temperature threshold being less than a second transport temperature threshold, such that the product can exceed the first temperature threshold for a threshold period of time while remaining below the second temperature threshold.

In some embodiments, the temperature control circuit autonomously activates the coolant dispensing system 314 to release evaporative coolant into the evaporative cavity 304 while the one or more products are transported by a delivery vehicle that is transporting the product cooling system 102. The coolant dispensing system, in some applications, includes one or more coolant reservoirs 324 that store one or more types of evaporative coolants. In some embodiments, the coolant dispensing system includes a control circuit and/or actuator 326, which may comprise a valve, plunger, puncture pin, compressed gas, or other such actuator that injects evaporative coolant into the evaporative cavity. In some instances, multiple coolant outlets are distributed around the evaporative cavity to provide a more equal distribution of the evaporative coolant through the evaporative cavity. Again, the temperature control circuit activates the coolant dispensing system to increase the quantity of evaporative coolant in the evaporative cavity 304 and exposed to the environment through the one or more evaporative openings 310 in an attempt to enhance or increase evaporation from the evaporative cavity. Some embodiments may include one or more heat sinks 318 in the evaporative cavity, in the product cavity and/or extending to an exterior of the system. One or more dispensers may be positioned to release the evaporative coolant to contact one or more heat sinks 318, which may be in contact with one or more products (e.g., part of the packaging or in contact with packaging of the product) and/or extending from the product cavity.

Figure 4:
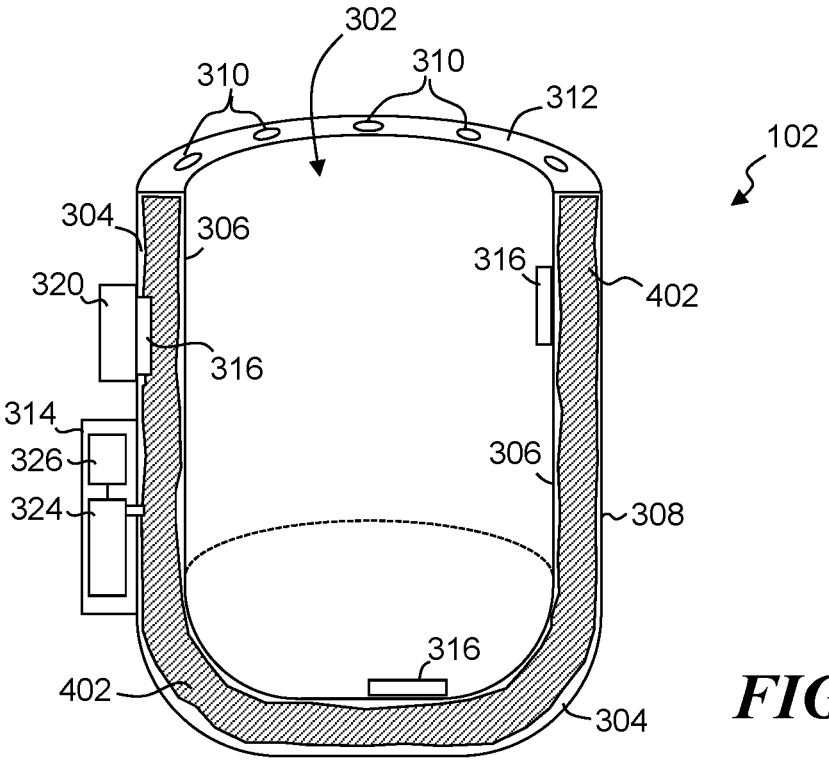
FIG. 4 illustrates a simplified block diagram of an evaporative product cooling system that further includes one or more fluid distributing materials, in accordance with some embodiments.

Some embodiments include one or more fluid distributing and/or absorbent materials within the evaporative cavity. FIG. 4 illustrates a simplified block diagram of an evaporative product cooling system 102 that further includes one or more fluid distributing and/or absorbent materials 402, in accordance with some embodiments. The fluid distributing material is positioned within the evaporative cavity and configured to distribute the evaporative coolant toward the at least one evaporative opening 310. Additionally or alternatively, the fluid distributing material provides a more equal and consistent distribution of the coolant material about the evaporative cavity to enhance evaporation about the product cavity 302. The fluid distributing material can be substantially any material that can at least partially absorb and/or wick the coolant material and allow evaporation from the fluid distributing material. In some applications the fluid distributing material is a fibrous material that provides a relatively large surface area and/or allows airflow through the fibrous material. The fluid distributing material may further provide some insulation between the product cavity and the exterior environment.

Some embodiments include one or more separators (not shown) that establish one or more gaps between the fluid distributing material and one or both of the interior wall 306 and exterior wall 308. The gaps enable airflow within the evaporative cavity to enhance evaporation through numerous areas of and/or throughout the evaporative cavity. The separator may comprise one or more patterns of raised and/or lowered areas formed on the interior wall and/or exterior wall, posts or rods formed in the interior wall and/or exterior wall, posts or rods secured with the fluid distributing material, one or more meshes or screens secured with the fluid distributing material and/or inserted between the fluid distributing material and one or both of the interior and exterior walls, other such separators or combination of two or more of such separators.

In some embodiments, the product cooling system 102 includes a vent system that can be manually controlled by a worker or automatically controlled by the temperature control circuit 320. The vent system can cooperate with one or more of the evaporative opening. The temperature control circuit can, as a function of at least the current temperature data of the first product, couple with the vent system and issue commands to control the vent system to control a volume of airflow through the evaporative openings and into the evaporative cavity.

Some embodiments include two or more evaporative coolant reservoirs 324, and at least two of those reservoirs can include different types of evaporative coolants. A primary coolant reservoir may be included that can store a first or primary evaporative coolant that has a first evaporation rate. A secondary reservoir can store a secondary evaporative coolant that has a second evaporation rate that is different than the first evaporation rate. For example, the secondary coolant can have the second evaporation rate that is greater than the first evaporation rate such that the secondary evaporative coolant evaporates more rapidly than the first evaporative coolant when both are in the same conditions. The multiple different evaporative coolants can provide the temperature control circuit with greater control over the temperature maintained within the product cavity 302 and/or the rate of reducing the temperature within the product cavity. In some instances, for example, the temperature control circuit can identify that a current temperature corresponding to a product and/or the temperature of the product in the product cavity is greater than a rapid cool transport temperature threshold, which may be different that a transport temperature threshold. When the temperature control circuit detects that temperature being greater than the rapid cool transport temperature threshold the temperature control circuit can activate the dispensing system (or a secondary dispensing system associated with the secondary reservoir) to inject the secondary evaporative coolant into the evaporative cavity. With the greater evaporation rate, the secondary evaporative coolant should evaporate at a faster rate and is expected to provide a more rapid temperature reduction within the product cavity. Similarly, the two or more different evaporative coolants can cooperatively be used to achieve a desired temperature and/or maintain a temperature within multiple different thresholds do to the variations in concentrations of the two or more evaporative coolants used.

As described above, the temperature control selection system 106 can select a type of temperature control and/or cooling system from multiple different types of temperature control and/or cooling systems. For example, the temperature control selection system may consider the evaporative product cooling system 102, a temperature pack product cooling system, a cryogenic product cooling system, aerosol product cooling system, a cooled sustaining container product cooling system, other such temperature control systems, or systems that include two or more temperature control systems, such as two or more of the above described product cooling systems. In some embodiments, the temperature control selection system considers a type or method of transport and delivery. For example, the method of transport may be through one or more methods such as, but not limited to, a delivery truck, a delivery van, a delivery car, an unmanned ground or land-based vehicle (UGV), an unmanned aircraft system (UAS), other such delivery methods, or combination of such delivery methods.

Some temperature control systems may not be suitable for some of the delivery methods, some temperature control systems may be more effective with some methods of delivery, and/or some temperature control systems may be more readily implemented with some delivery methods. Accordingly, the temperature control selection system may identify a scheduled method of delivering the one or more products, and select the evaporative cooling system as a method of temperature control based in part on the method of delivery. For example, when a method of delivery is through the use of a UAS or UGV, the cooling system may be exposed to the environment as the product is transported by the UAS or UGV. As such, the evaporative cooling system may be particularly beneficial with such delivery methods because the evaporative openings 310 are exposed to the environment, and in some instances evaporation is enhanced because of the exposure to the wind that is at least induced while the UAS or UGV is moving. Further, the weight of temperature control systems used particularly with UASs, and in some instances with UGVs, can make some cooling systems difficult to use. In many instances, the evaporative product cooling system 102 can be implemented to have a relatively light weight (e.g., interior and exterior walls being formed from light weight plastic, paper, cardboard, Styrofoam, other such materials or combination of two or more of such materials). Accordingly, the evaporative product cooling system can be a desired method of cooling with some delivery methods. Such delivery parameters corresponding to the method of delivery can be considered by the temperature control selection system, which can select the evaporative cooling system for some methods of transport and delivery. The selection may be based on the product(s), the delivery vehicle, product temperature threshold, exterior conditions and the like. For example, when the delivery vehicle is a UAS, the system may be selected with an aerodynamically enhanced shape and a reduced weight.

Further, in some implementations, the temperature control selection system may select two or more of the temperature control systems to be cooperatively utilized during the delivery, and/or one to be used as a primary cooling system with one or more to be utilized as secondary cooling method and/or backup cooling method. Further, multiple methods of delivery may be used (e.g., delivery truck and a UAS). Accordingly, multiple temperature control systems may be selected. The temperature control selection system, in some applications, is configured to obtain a temperature threshold of a product, identify a method of transporting the product by the delivery vehicle to the delivery location, and select from multiple different types of temperature control systems an evaporative temperature control system that comprises the product cooling system as a function of the method of transport. Other cooling systems are described in U.S. application Nos. 62/338,246 filed May 18, 2016 and entitled TEMPERATURE PACK COOLING SYSTEMS AND METHODS OF CONTROLLING PRODUCT TEMPERATURES DURING DELIVERY (137872); 62/338,231 filed May 18, 2016 entitled CRYOGENIC COOLING SYSTEMS AND METHODS OF CONTROLLING PRODUCT TEMPERATURES DURING DELIVERY (137873); 62/338,290 filed May 18, 2016 entitled SYSTEMS AND METHODS OF CONTROLLING PRODUCT TEMPERATURES DURING DELIVERY (137876); 62/345,443 filed Jun. 3, 2016 entitled TEMPERATURE CONTROL SYSTEMS USING TEMPERATURE SUSTAINING BAGS AND METHODS OF CONTROLLING PRODUCT TEMPERATURES DURING DELIVERY (138251); 62/403,909 filed Oct. 4, 2016 entitled SYSTEMS AND METHODS UTILIZING NANOTECHNOLOGY INSULATION MATERIALS IN LIMITING TEMPERATURE CHANGES DURING PRODUCT DELIVERY (137874); 62/350,515 filed Jun. 16, 2016 entitled SYSTEMS AND METHODS OF CONTROLLING PRODUCT TEMPERATURES DURING DELIVERY (138259); 62/367,376 filed Jul. 27, 2016 entitled SYSTEMS AND METHODS FOR DELIVERING PERISHABLE ITEMS (138262); and Ser. No. 15/598,718 filed May 18, 2017 entitled SYSTEMS AND METHODS OF CONTROLLING PRODUCT TEMPERATURES DURING DELIVERY; all of which are incorporated herein by reference in their entirety.

In some embodiments, the evaporative cooling system is configured for use in relatively short duration transports. For example, the evaporative cooling system may be limited to transport times that correspond to approximately the flight time of a UAS to a delivery location, and typically with a margin of error, such as +50% of the flight time. As further examples, the evaporative cooling system may be limited to transport times (which can include time to stage the product and cooling system, load the delivery vehicle, transport the product, and deliver the product to the customer, and in some instances may include time after delivery before a customer is expected to retrieve the delivery) of less than eight hours, and in some instances restricted to transport times of less than four hours.

Again, in some embodiments the delivery vehicle can be an unmanned aircraft system (UAS). The UAS is configured to secure and lift the evaporative product cooling system and the one or more products supported by the product cooling system while the UAS transports the product cooling system and the product by air to the delivery location. The evaporative product cooling system limits a temperature change of the product by, at least in part, limiting a temperature difference between an interior of the product cavity 302 and the evaporative cavity 304 and providing a temperature barrier between the product cavity 302 and the exterior environment, thereby limiting and/or reducing the rate of temperature change of the interior of the product cavity and the one or more products within the product cavity.

The temperature control circuit, in some applications, can further be configured to control an airflow around, across and/or into the evaporative openings 310 to control a rate of evaporation of the one or more evaporative coolants. In some embodiments, the temperature control circuit can determine a desired orientation of the product cooling system and one or more of the evaporative openings relative to a direction of travel while in transit to achieve a desired airflow across and/or through one or more evaporative openings and into or through the evaporative cavity 304. The rate of evaporation can be increased or decreased in at least some implementations by adjusting airflow into and/or through the evaporative cavity. In some embodiments, the temperature control circuit considers the evaporation rate of the evaporative coolant, and historic data corresponding to changes in evaporation rate and/or temperatures within the product cavity as a function of changes in airflow across and/or into the evaporative openings. The temperature control circuit further has knowledge of the positioning and/or configuration of the evaporative openings and can cause an adjustment in orientation to cause an adjustment in airflow relative to one or more evaporative openings. In some embodiments, the product cooling system 102 may include one or more airflow sensors that can provide airflow data to the temperature control circuit. The temperature control circuit can utilize this airflow data in cooperation with a current orientation, positioning and/or mapping of the evaporative openings and a desired change in evaporation to achieve a desired temperature within the product cavity.

The temperature control circuit can autonomously communicate one or more instructions to cause a modification of the orientation of the product cooling system 102 as the delivery vehicle travels toward the delivery location to modify the airflow through the at least one evaporative opening. For example, when the delivery vehicle is a UAS, the instruction can be communicated to the UAS to cause the UAS to rotate a specified number of degrees relative to a direction of travel. Similarly, when the delivery vehicle is a UGV, the instruction can cause the UGV to change directions for a period of time and/or activate a mechanism on the UGV to rotate the product cooling system 102.

Further, in some implementations, the temperature control circuit can determine a desired velocity of the delivery vehicle as a function of the received temperature data and/or airflow data to control a rate of evaporation of the evaporative coolant within the evaporative cavity. Similar to the evaluation of orientation, the temperature control circuit can evaluate historic data relative to causing changes in evaporation rates and/or changes in temperature within the evaporative cavity and/or the product cavity, relative to one or more parameters such as but not limited to type of evaporative coolant, environmental temperature, desired temperature within the product cavity and/or of the product, temperature or estimated temperature of the product relative to one or more temperature thresholds, other such parameters, and often two or more of such parameters. When a change in velocity is desired, the temperature control circuit can autonomously communicate an instruction to the delivery vehicle to cause a modification in velocity of the delivery vehicle to be consistent with the desired velocity. This control in velocity may be made in cooperation with or alternative to a change in orientation of the product cooling system 102 (and/or evaporative openings) relative to a direction of travel. In some applications, the temperature control circuit may communicate (e.g., via wireless communication, such as cellular, Wi-Fi, etc.) with a central control system that may evaluate some or all of the data, such as temperature data, airflow data and/or other such data to determine adjustments that the temperature control circuit is to implement. Typically, however, the temperature control circuit can operate autonomously without communicating with the central control system in determining when and/or whether to make adjustments to inject coolant, increase a rate of injection of coolant, cause an adjustment of an orientation of the delivery vehicle, cause an adjustment of an orientation of the evaporative product cooling system 102, cause an adjustment of a speed of the delivery vehicle, activate a secondary coolant delivery, activate a secondary cooling system, and/or other such actions.

Although FIGS. 3-4 show a cooling system with a single product cavity 302, other embodiments may include multiple different product cavities. Similarly, although FIGS. 3-4 show a cooling system with a single evaporative cavity, other embodiments may include multiple different evaporative cavities. The organization and/or positioning of the different evaporative cavities may be configured so that a one or more first evaporative cavities are positioned adjacent a first product cavity, and a first evaporative coolant with a first evaporation rate can be injected into the first one or more evaporative cavities. Further, one or more second evaporative cavities can be positioned adjacent a second product cavity, and a second evaporative coolant with a second evaporation rate can be injected into the second one or more evaporative cavities. In other configurations, one or more first evaporative cavities may be positioned adjacent a first product cavity, and one or more second evaporative cavities can be positioned adjacent the first product cavity. A first evaporative coolant can be configured to be injected into the first one or more evaporative cavities, and a second evaporative coolant can be configured to be injected into the second one or more evaporative cavities. Again, the different evaporative coolants can provide different evaporation rates, and thus provide different rates of heat transfer relative to the one or more product cavities.

Some embodiments additionally or alternatively take advantage of ambient conditions to implement evaporative cooling and/or enhance the evaporative cooling. In some instances, a UAS delivery vehicle may fly through a cloud that deposits moisture on at least the exterior wall 308. This exterior moisture evaporates to enhance the cooling and/or limit a change in temperature within the evaporative cavity 304 and product cavity 302. The continued flight of the UAS delivery vehicle can be controlled to further adjust a rate of evaporation of the moisture that adheres to the exterior walls. For example, the temperature control circuit 320 can receive temperature sensor data and detect a change in temperature of the exterior wall and/or a change in the rate of change of temperature within the evaporative cavity to identify an evaporative effect on the exterior wall. Additionally or alternatively, one or more moisture sensors may be positioned to detect exterior moisture. The rate of evaporation of the exterior moisture in part can be controlled based on a speed of the UAS delivery vehicle, an orientation of the product cooling system 102 while being transported, rate of injection of evaporative coolant within the evaporative cavity, and the like.

Further, in some embodiments, the temperature control circuit 320 may receive an indication of exterior moisture and cause a change in orientation of the product cooling system while the exterior moisture is present to enhance a distribution of the exterior moisture across a larger area of the exterior wall and/or all of the exterior wall. Similarly, one or more evaporative openings 310 may be adjusted to reduce evaporation from the evaporative cavity 304 as a result of the exterior moisture and expected enhanced exterior evaporation. In some implementations, the UAS delivery vehicle may be routed with attempts to interact with clouds, fog or other conditions to take advantage of exterior moisture and evaporative effects, which can save evaporative coolant, battery power, and the like. For example, it may be identified through one or more remote sensors and/or weather data that clouds are present at a determined altitude, and the UAS delivery vehicle can be directed by the temperature control circuit and/or a central system to fly at an altitude that is expected to allow the product cooling system to interact with the exterior moisture. The temperature control circuit 320 and/or a central system can evaluate current conditions relative to historic conditions in identifying when it is expected that sufficient external moisture sources are to be available along a delivery route. Further, in some implementations the delivery route may be modified to allow the product cooling system to interact with expected exterior moisture sources.

Figure 5:
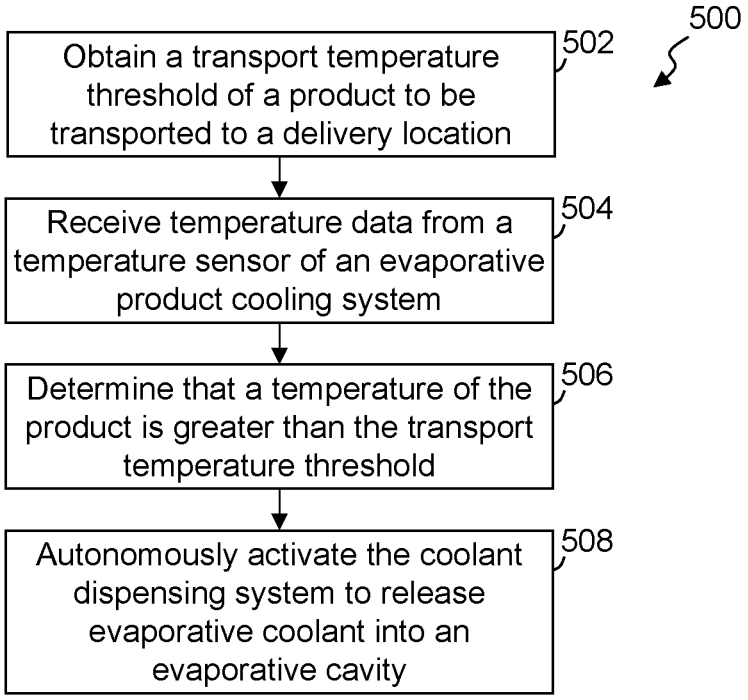
FIG. 5 illustrates a simplified flow diagram of an exemplary process of limiting temperature changes of a product during transit, in accordance with some embodiments.

FIG. 5 illustrates a simplified flow diagram of an exemplary process 500 of limiting temperature changes of a product during transit, in accordance with some embodiments. In step 502, a transport temperature threshold is obtained for a product to be transported to a delivery location by a delivery vehicle. Again, one or more temperature thresholds (and in some instances corresponding duration thresholds) may be associated with a product. The temperature threshold may be a minimum temperature, a maximum temperature, a desired transport temperature, a temperature associated with a corresponding duration of time, or the like.

In step 504, temperature data is received while the product is being transported to the delivery location by the delivery vehicle. In some embodiments, the temperature data is received from one or more temperature sensors of an evaporative product cooling system 102. The evaporative product cooling system is typically separate from and removable from the delivery vehicle, and supports at least the product within a product cavity while in transit to the delivery location. In some implementations, the evaporative product cooling system and/or a size of an evaporative cooling system is selected at least in part based on a volume, shape and/or dimensions of the product cavity relative to the product to be placed into the product cavity. For example, the selected evaporative product cooling system selected may have dimensions that are similar to the product being delivered and adds less than 20% to the volume of space occupied by the product, and in some instances adds less than 10%.

In step 506, it is determined based on current temperature data that a temperature of the product within the product cavity is greater than the transport temperature threshold associated with the product. In step 508, a coolant dispensing system is autonomously activated while the product is transported by the delivery vehicle. The activation of the dispensing system causes one or more types of evaporative coolant to be released into an evaporative cavity 304 of the product cooling system while at least one evaporative opening 310 is exposing a portion of the evaporative cavity to an exterior environment.

Some embodiments release the evaporative coolant into the evaporative cavity causing the evaporative coolant to contact a fluid distributing material within the evaporative cavity. The fluid distributing material is configured to distribute the evaporative coolant toward the at least one evaporative opening, more equally distribute the coolant material within the evaporative cavity than when the fluid distributing material is not present, and/or maintain the fluid distributing material proximate the interior wall 306.

Many different types of delivery vehicles may be used. In some embodiments, the evaporative cooling system is cooperated an unmanned aircraft system (UAS). Some embodiments cause the delivery vehicle, comprising an unmanned aircraft system (UAS), to lift the product cooling system and the one or more products supported by the product cooling system and transport the product cooling system and the one or more products by air to the delivery location. In some implementations, a desired orientation of the product cooling system and the at least one evaporative opening can be determined, while the product is in transit, relative to a direction of travel to achieve a desired airflow through the at least one evaporative opening and into the evaporative cavity 304. One or more instructions can be communicated to cause a modification of the orientation of the product cooling system as the delivery vehicle travels toward the delivery location and modify the airflow through the at least one evaporative opening. The communication may be directed to the delivery vehicle, or an orientation system that can alter the orientation of the product cooling system while in transit. In some instances, a temperature control circuit 320 can communicate directly to the delivery vehicle. In other instances, the temperature control circuit may communicate to a central control system that can cause one or more instructions to be communicated to the delivery vehicle to cause a change in orientation of the product cooling system relative to the delivery vehicle and/or a direction of travel.

Some embodiments determine a desired velocity of the delivery vehicle as a function of the received temperature data to control a rate of evaporation of the evaporative coolant within the evaporative cavity. One or more instructions can be autonomously communicated to the delivery vehicle to cause a modification in a velocity of the delivery vehicle to be consistent with the desired velocity. In some embodiments, a vent system of the product cooling system is controlled in controlling a volume of airflow through the at least one evaporative opening and into the evaporative cavity as a function of the current temperature data of the product.

A method of transporting the product by the delivery vehicle to the delivery location can be identified in some embodiments. The evaporative product cooling system may be selected from multiple different types of temperature control systems, at least in part, as a function of the method of transport. Again, the evaporative product cooling system comprises at least the evaporative cavity and evaporative coolant. As described above, the evaporative product cooling system may be used with one or more different types of delivery methods and/or with one or more different types of delivery vehicles, while may not being practical for other types of delivery methods. Further, the evaporative cooling system may be more practical with some methods of transport and/or delivery vehicles than with others. For example, the evaporative product cooling system may be more effective with delivery vehicles that can allow and/or direct air flow generated by the movement of the delivery vehicle to pass along and/or into one or more of the evaporative openings 310 and/or where airflow across and/or into one or more evaporative openings can at least partially be controlled. Further, some embodiments evaluate the one or more products to be transported and the corresponding one or more temperature thresholds associated with each of those one or more products. The selection of the evaporative product cooling system over the multiple other potential cooling systems is typically further dependent on the one or more temperature thresholds, types of products, and/or the transportation parameters.

Additionally, in some embodiments, multiple different types and/or configurations of the evaporative product cooling system may be available. Typically, multiple different sizes of evaporative product cooling systems 102 are available and a particular one can be selected based in part on the number of products being transported and the size or volume of the one or more products. For example, some embodiments may provide multiple different sized evaporative product cooling systems, and the sized evaporative product cooling system may be selected to be the smallest available system that can receive the one or more products and be used to transport the one or more products. In some embodiments, the temperature control selection system 106 and/or other system can obtain an optimum stacking and/or positioning of the multiple products within the one or more product cavities, and instructions can be provided to a worker (e.g., written, illustrations, etc. that can be communicated to a personal device (e.g., smartphone, tablet, etc.), displayed through a computer, communicated as an email or text, or otherwise provided to the worker) to direct the worker in positioning products within the product cavity of the selected evaporative product cooling system. Similarly, the system may select one or more evaporative coolants to be used and provide instructions that direct the worker to cooperate one or more types of evaporative coolants with the selected product cooling system (e.g., attach a coolant reservoir 324 with a coolant dispensing system 314). The selection of the evaporative product cooling system can further depend on the evaporative openings parameters (e.g., size, shape, number, orientation, and/or other such factors). Further, some embodiments may enable the size of the openings to be adjusted based on desired airflow rates.

In some embodiments, the product cooling system may utilize multiple different evaporative coolants that can provide different evaporation rates. These different evaporative coolants can be used independently and/or collectively. For example, some embodiments identify that the temperature of a product is greater than a second transport temperature threshold. A coolant dispensing system 314 can be autonomously activated to inject a secondary evaporative coolant into the evaporative cavity and/or a secondary evaporative cavity. The secondary evaporative coolant can have a second evaporation rate that is greater than a first evaporation rate of the evaporative coolant such that the secondary evaporative coolant evaporates more rapidly than the first evaporative coolant when in the same conditions. The injection of the secondary evaporative coolant can result in a more rapid evaporation, which can help to reduce the temperature within the product cavity.

In some embodiments, systems, apparatuses, methods and processes are provided to limit temperature changes of a product during delivery. Some embodiments provide systems comprising an evaporative product cooling system comprising: a product cavity that supports a first product while the first product is transported to a delivery location by a delivery vehicle, wherein the product cooling system is separate from and removable from the delivery vehicle and comprises an interior wall defining the product cavity, an exterior wall, an evaporative cavity defined between the interior wall and the exterior wall, a coolant dispensing system coupled with the evaporative cavity, at least one evaporative opening exposing a portion of the evaporative cavity to an exterior environment, and a temperature sensor positioned to detect in real time a temperature corresponding to a temperature of the first product while the first product is in transit to be delivered to a delivery location; and a temperature control circuit coupled with the temperature sensor and the coolant dispensing system, wherein the temperature control circuit is configured to receive temperature data from the temperature sensor while the first product is in transit to the delivery location, determine based on current temperature data that a temperature of the first product is greater than a first transport temperature threshold, and autonomously activate the coolant dispensing system to release evaporative coolant into the evaporative cavity while the first product is transported by the delivery vehicle.

Further, some embodiments provide methods of limiting temperature changes of a product during transit. Some of these methods comprise: obtaining a first transport temperature threshold of a first product to be transported to a delivery location by a delivery vehicle; receiving, while the first product is being transported to the delivery location by the delivery vehicle, temperature data from a temperature sensor of an evaporative product cooling system that is separate from and removable from the delivery vehicle and that supports the first product within a product cavity while in transit to the delivery location; determining based on current temperature data that a temperature of the first product is greater than the first transport temperature threshold; and autonomously activating the coolant dispensing system, while the first product is transported by the delivery vehicle, to release evaporative coolant into an evaporative cavity of the product cooling system while at least one evaporative opening is exposing a portion of the evaporative cavity to an exterior environment.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A system to limit temperature changes of one or more products during transit, comprising:

an evaporative cooling system comprising:

a product cavity that supports a first product while the first product is transported to a delivery location by a delivery vehicle, wherein the cooling system is separate from and removable from the delivery vehicle and comprises an interior wall defining the product cavity, an exterior wall, an evaporative cavity defined between the interior wall and the exterior wall, a coolant dispensing system coupled with the evaporative cavity, at least one evaporative opening exposing a portion of the evaporative cavity to an exterior environment, and a temperature sensor positioned to detect temperature data corresponding to a temperature of the first product while the first product is in transit to be delivered to the delivery location; and a temperature control circuit coupled with the temperature sensor and the coolant dispensing system, wherein the temperature control circuit is configured to receive the temperature data from the temperature sensor while the first product is in transit to the delivery location, determine based on the temperature data that the temperature of the first product is greater than a first transport temperature threshold, and autonomously activate the coolant dispensing system to release evaporative coolant into the evaporative cavity while the first product is transported by the delivery vehicle;

wherein the cooling system further comprises:

a primary coolant reservoir configured to store the evaporative coolant having a first evaporation rate; and a secondary reservoir configured to store a secondary evaporative coolant having a second evaporation rate that is greater than the first evaporation rate such that the secondary evaporative coolant evaporates more rapidly than the first evaporative coolant when in the same conditions;

wherein the temperature control circuit is configured to identify that the temperature of the first product is greater than a second transport temperature threshold, and activate the coolant dispensing system to inject the secondary evaporative coolant into the evaporative cavity.

2. The system of claim 1, wherein the cooling system further comprises a fluid distributing material within the evaporative cavity configured to distribute the evaporative coolant toward the at least one evaporative opening.

3. The system of claim 1, wherein the delivery vehicle comprises an unmanned aircraft system (UAS) configured to secure and lift the cooling system and the first product supported by the cooling system while the UAS transports the cooling system and the first product by air to the delivery location.

4. The system of claim 1, wherein the temperature control circuit is further configured to determine an orientation of the cooling system and the at least one evaporative opening relative to a direction of travel to achieve a controlled airflow through the at least one evaporative opening and into the evaporative cavity in response to the temperature of the first product being greater than the first transport temperature threshold, and to communicate an instruction to cause a modification of the orientation of cooling system as the delivery vehicle travels toward the deliver location to modify the airflow through the at least one evaporative opening.

5. The system of claim 1, wherein the temperature control circuit is further configured to determine a change to velocity of the delivery vehicle as a function of the temperature data to control a rate of evaporation of the evaporative coolant within the evaporative cavity, and autonomously communicate an instruction to the delivery vehicle to cause the change to the velocity of the delivery vehicle.

6. The system of claim 1, wherein the cooling system comprises a vent system cooperated with the at least one evaporative opening, wherein the temperature control circuit couples with the vent system to control the vent system in controlling a volume of airflow through the at least one evaporative opening and into the evaporative cavity as a function of the temperature data of the first product.

7. The system of claim 1, further comprising:

a temperature control selection system configured to obtain a temperature threshold of the first product, identify a method of transport of the first product by the delivery vehicle to the delivery location, and select from multiple different types of temperature control systems an evaporative temperature control system comprising the cooling system as a function of the method of transport.

8. A method of limiting temperature changes of one or more products during transit, comprising:

obtaining a first transport temperature threshold of a first product to be transported to a delivery location by a delivery vehicle;

receiving, while the first product is being transported to the delivery location by the delivery vehicle, temperature data from a temperature sensor of an evaporative cooling system that is separate from and removable from the delivery vehicle and that supports the first product within a product cavity while in transit to the delivery location;

determining based on current temperature data that a temperature of the first product is greater than the first transport temperature threshold;

autonomously activating the coolant dispensing system, while the first product is transported by the delivery vehicle, to release evaporative coolant into an evaporative cavity of the cooling system while at least one evaporative opening is exposing a portion of the evaporative cavity to an exterior environment;

identifying that the temperature of the first product is greater than a second transport temperature threshold; and autonomously activating the coolant dispensing system to inject a secondary evaporative coolant into the evaporative cavity, wherein the secondary evaporative coolant has a second evaporation rate that is greater than a first evaporation rate of the evaporative coolant such that the secondary evaporative coolant evaporates more rapidly than the first evaporative coolant when in the same conditions.

9. The method of claim 8, wherein the releasing the evaporative coolant into the evaporative cavity comprises causing the evaporative coolant to be in contact with a fluid distributing material within the evaporative cavity that distributes the evaporative coolant toward the at least one evaporative opening.

10. The method of claim 8, further comprising:

causing the delivery vehicle, comprising an unmanned aircraft system (UAS), to lift the cooling system and the first product supported by the cooling system and transport the cooling system and the first product by air to the delivery location.

11. The method of claim 8, further comprising:

determining, while the first product is in transit, an orientation of the cooling system and the at least one evaporative opening relative to a direction of travel to achieve a controlled airflow through the at least one evaporative opening and into the evaporative cavity; and communicating an instruction to cause a modification of the orientation of the cooling system as the delivery vehicle travels toward the delivery location and modify the airflow through the at least one evaporative opening.

12. The method of claim 8, further comprising:

determining a change to velocity of the delivery vehicle as a function of the temperature data to control a rate of evaporation of the evaporative coolant within the evaporative cavity; and autonomously communicating an instruction to the delivery vehicle to cause the change to the velocity of the delivery vehicle.

13. The method of claim 8, further comprising:

controlling a vent system of the cooling system in controlling a volume of airflow through the at least one evaporative opening and into the evaporative cavity as a function of the temperature data of the first product.

14. The method of claim 8, further comprising:

identifying a method of transport of the first product by the delivery vehicle to the delivery location; and selecting from multiple different types of temperature control systems the evaporative cooling system with the evaporative cavity and evaporative coolant as a function of the method of transport.

* * * * *